United States Patent [19]

Michael

[11] 4,307,640

[45] Dec. 29, 1981

[54] CHAIN SAW APPARATUS FOR CUTTING WOOD

[76] Inventor: Melvin E. Michael, 645 C. R. 97, Fremont, Ohio 43420

[21] Appl. No.: 157,801

[22] Filed: Jun. 9, 1980

[51] Int. Cl.[3] ..... B27B 17/02

[52] U.S. Cl. ..... 83/574; 83/796; 83/798; 83/799

[58] Field of Search ..... 83/574, 796, 798, 799

[56] References Cited

U.S. PATENT DOCUMENTS

| | | | |
|---|---|---|---|
| 710,838 | 10/1902 | Brines . | |
| 1,576,051 | 3/1926 | Jull . | |
| 2,851,067 | 9/1958 | Greenslate | 83/796 |
| 3,053,290 | 9/1962 | Fitzgerald | 83/574 X |
| 4,127,046 | 11/1978 | Jackson | 83/798 |
| 4,146,962 | 4/1979 | Grube . | |
| 4,215,612 | 8/1980 | Peel | 83/796 |

FOREIGN PATENT DOCUMENTS

| | | | |
|---|---|---|---|
| 1384843 | 11/1964 | France | 83/799 |
| 7832174 | 7/1980 | France | 83/574 |
| 374192 | 2/1964 | Switzerland | 83/799 |

*Primary Examiner*—Donald R. Schran
*Attorney, Agent, or Firm*—Charles W. Swope

[57] ABSTRACT

A method of cutting logs which involves swinging a chain saw about a fixed pivot to bring the chain of the saw into cutting engagement with a log while the log is supported in an elevated position and restrained from lateral movement; together with an apparatus therefor which includes a table having a trough shaped log supporting top, and provided with a pivoted and adjustable mounting plate for the chain saw.

3 Claims, 6 Drawing Figures

CHAIN SAW APPARATUS FOR CUTTING WOOD

BACKGROUND

1. Field of the Invention

The present invention is concerned with cutting machines generally and, more particularly, with an improved method of, and apparatus for, chain sawing logs or other elongated timbers into shorter lengths.

2. The Prior Art

The use of chain saws in cutting fire wood is of course well known. However, heretofore, it has been considered to be a potentially dangerous procedure, and the efficiency and effectiveness of the operation, as well as the prevention of injury to the cutting edges or blades of the saw chain, have been entirely dependent on the skill of the individual operator.

SUMMARY OF THE INVENTION

The present invention, on the other hand, insures an accurately controlled cutting operation, during which the chain saw will be held at what has been predetermined to be the desired angular relationship with the log to be cut, and will be moved into cutting engagement with and through the log along what has been predetermined to be the desired path of cutting movement.

Accordingly, it is an important object of this invention to provide an improved method and apparatus for cutting logs that will greatly reduce, if not entirely eliminate the danger of physical injury to which chain saw operators generally, and new owners of chain saws in particular, have heretofore been subject.

Another object is to provide such a method and apparatus that will improve the accuracy, effectiveness and efficiency of chain saw cutting by insuring that the angle of the saw in relation to the work, and the movement of the saw during its cutting stroke, can not only be predetermined and controlled, but can be accurately and identically repeated for any number of successive cuts.

Another object is to provide an apparatus for cutting logs into shorter lengths, that includes a supporting table and a chain saw mounted for pivoted swinging movement relative to the table, and in which the saw may be removed from the table for use in felling a tree and then remounted for use in cutting logs from the felled tree into fire wood.

Further objects and advantages will become apparent during the course of the following description when taken in connection with the accompanying drawings.

In the drawings, wherein like numerals refer to like parts throughout:

DESCRIPTION OF A PREFERRED EMBODIMENT

Figure 1:
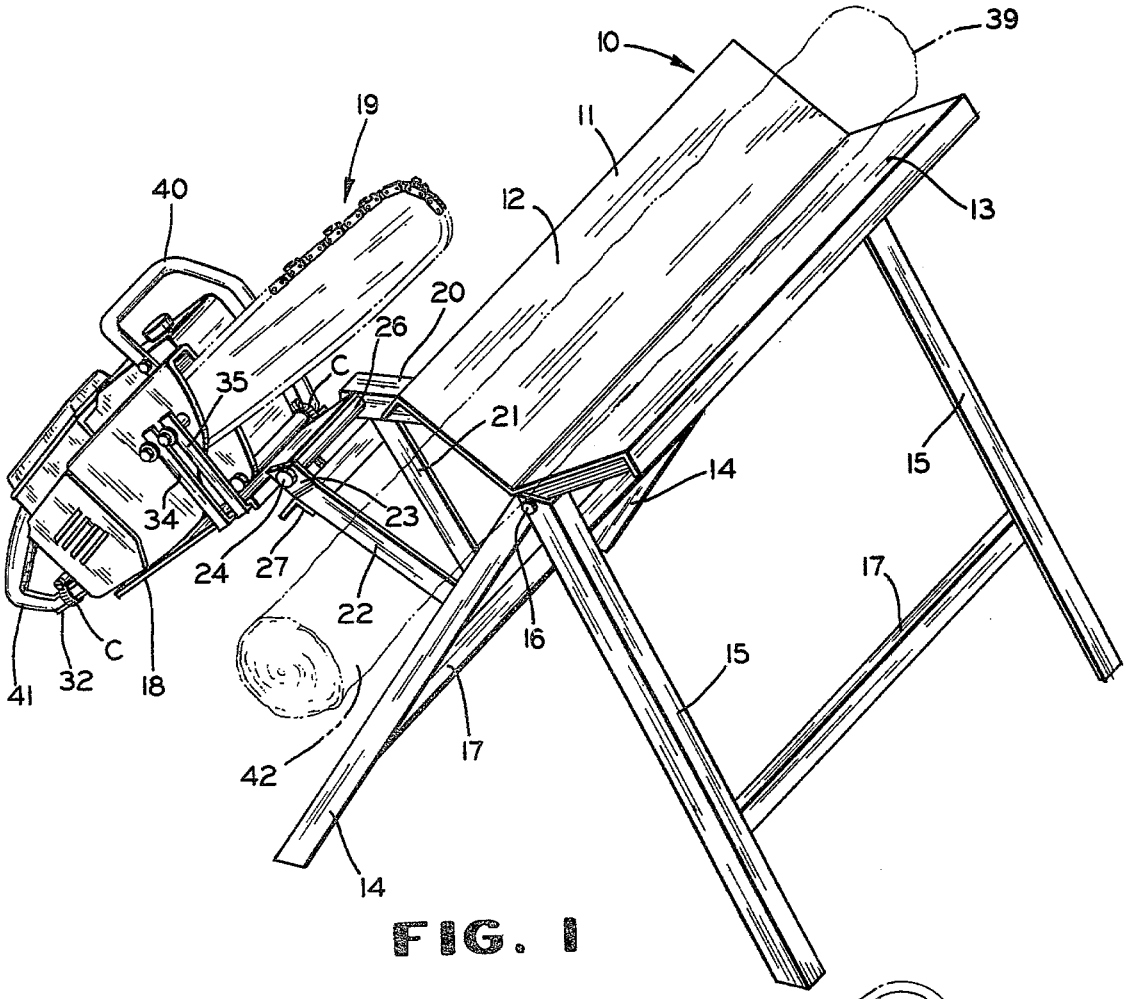
FIG. 1 is a perspective view of the complete apparatus of the invention, showing, in broken lines, a log positioned and supported for cutting into lengths.
Figure 2:
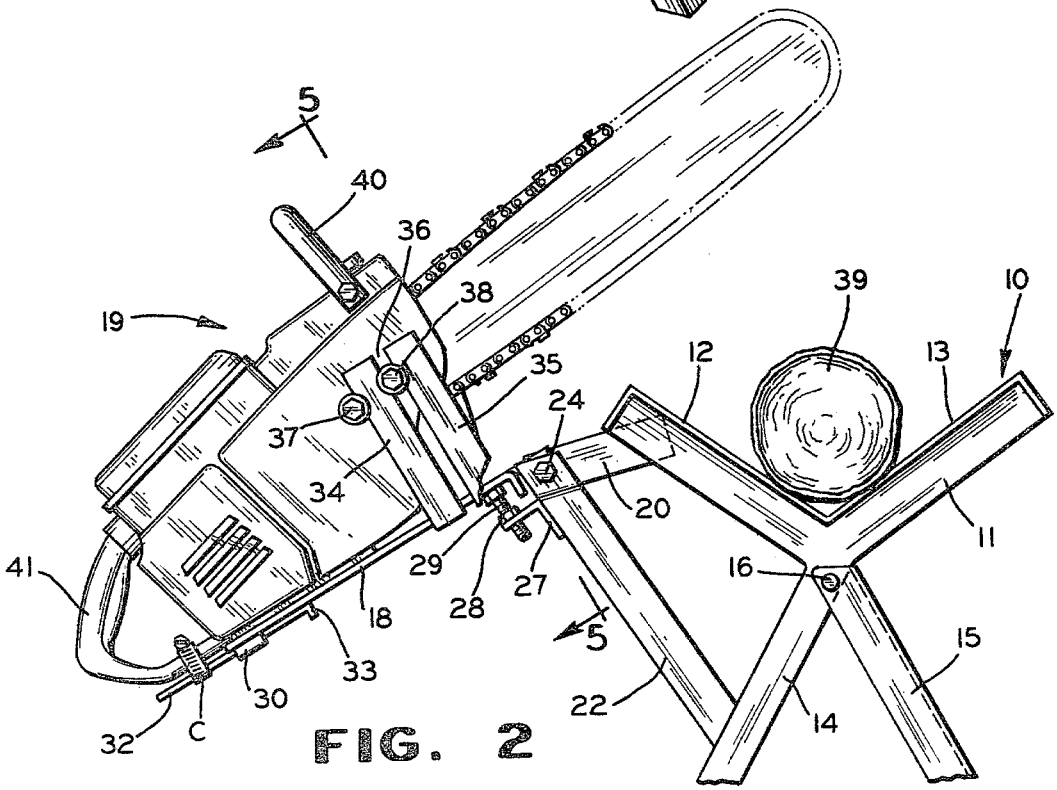
FIG. 2 is an end view of the apparatus of FIG. 1; with the log in full lines and the lower part of the table legs broken away.
Figure 3:
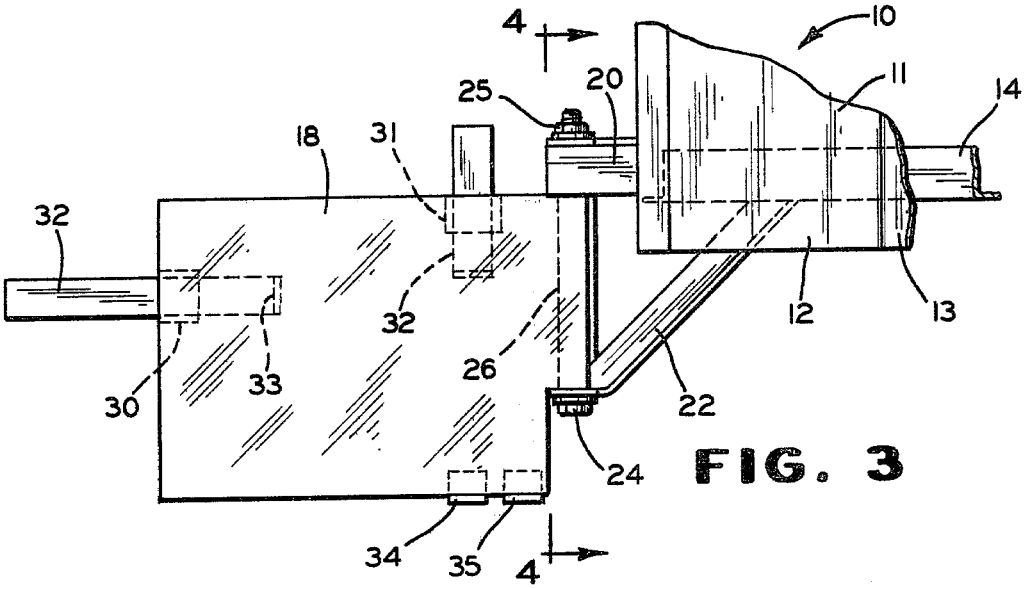
FIG. 3 is a fragmentary plan view of a part of one end of the log supporting table with the mounting plate for the chain saw in horizontal position.
Figure 4:
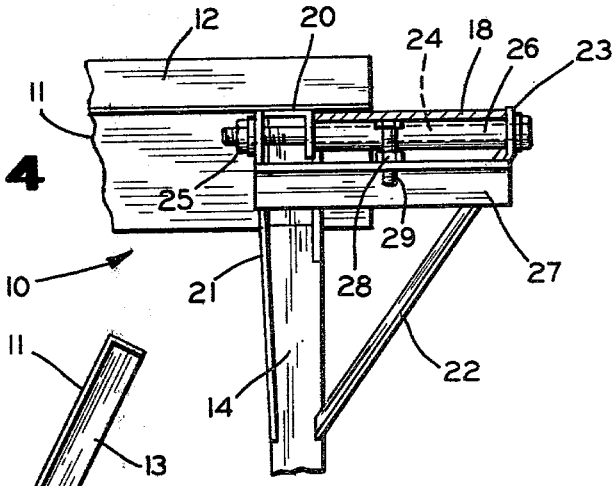
FIG. 4 is a transverse sectional view taken substantially along the line 4—4 in FIG. 3.
Figure 6:
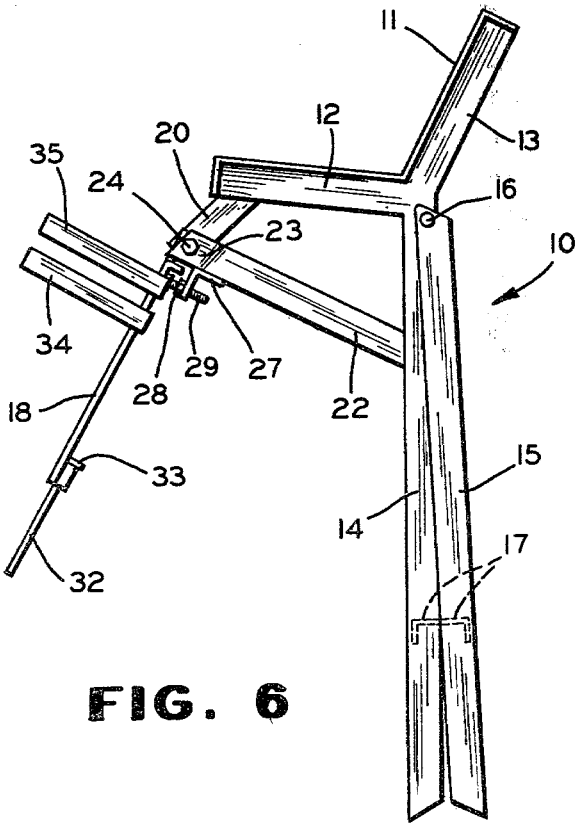
FIG. 6 is an end view of the table of the invention, showing two of its legs swung into folded position for transportation or storage.

Referring now more particularly to the drawings, the complete apparatus as illustrated in FIG. 1 includes a table 10 provided with a trough shaped top 11 that is made up of plates 12 and 13 joined or otherwise secured together in edge abutting, "V" shaped, angular relationship. To support the table top 11 in elevated, off the ground, position, pairs of legs 14 and 15 extend downwardly from the opposite ends of the table top at the juncture of the abutting plates 12 and 13. The legs 14 of each pair can be formed integral with the table top 11, while the legs 15 are preferably pivoted to the top or to the adjacent leg 14 as at 16; and the legs 14—14 and 15—15 are connected together by cross braces 17. In this way the table 10 can be solidly supported in its open or operative position as shown in FIGS. 1 and 2, or folded for transportation or storage as shown in FIG. 6.

To properly position, guide, and control a chain saw, when being used in combination with the log supporting table 10 of the invention, there is provided a mounting plate 18 that is adapted to support a conventional chain saw 19 for pivotal, swinging movement relative to the table top. To this end, there extends outwardly from the plate 12 of the top 11, near an end thereof and adjacent its upward or free edge, a projection 20 in the shape of an angle iron that is connected to the adjacent leg 14 by a plate type brace 21. Also, extending upwardly and outwardly from the same leg 14 is a flat cross brace 22, the free end of which is turned upwardly as at 23. And, journaled in the vertical leg of the angular projection 20 and in the upwardly turned free end of the flat cross brace 22, adjacent the outer ends thereof, is a bolt 24 provided with a nut 25 and surrounded by a sleeve 26 that is welded to the bottom surface of the mounting plate 18.

With this structure the mounting plate 18 is pivoted about the bolt 24 to swing forward and back relative to the table 10 and, to control the extent of its backward and downward swinging movement, there is provided an angle iron 27, secured at its opposite ends to the cross braces 21 and 22, and provided with a nut 28 through which is threaded an adjusting screw 29 the upper or headed end of which engages and acts as a stop against the bottom of the plate 18.

The chain saw 19 can be mounted on and secured to and against the upper surface of the plate 18 in any suitable or desired manner. By way of example and, in a preferred form, there are secured to the under surface of the plate 18 slides 30 and 31, with the slide 30 being at and facing outwardly from the free end of the plate 18 while the slide 31 is at and faces outwardly from the side of the plate that is nearest the table 10. Moveable back and forth within the slides 30 and 31 are slide members 32 in the form of plates having downturned end portions 33.

Additionally, there are provided at the side of the plate 18 that is away from the table and adjacent the pivoted end of the plate a pair of "L" shaped uprights 34 and 35 the horizontal legs of which are secured to the under surface of the table 18 and the vertical legs of which provide a slot 36 therebetween.

To mount the saw 19 on the plate 18, the saw is located on the upper surface of the plate and positioned (as shown in FIGS. 1 and 2) so that (1) the chain is just beyond and will clear the end of the table top 11, and (2) so that the saw will move into proper cutting engagement with a log that is supported on the top, when the plate 18 with the saw thereon is swung toward the table 10.

Figure 5:
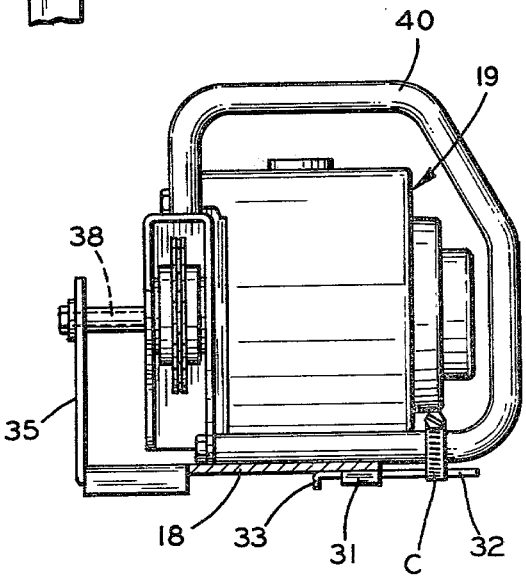
FIG. 5 is a vertical sectional view taken substantially along the line 5—5 in FIG. 2.

With the saw properly positioned, it can be tightly secured to the plate 18 by clamps C, which may be conventional flexible steel hose clamps, that are tightened around the side handle 40 of the saw and the outer end of the slide member 32 in the slide 31 (FIGS. 1 and 5), and by tightening a similar flexible clamp around the rear handle 41 of the saw and the outer end of the slide member 32 in the slide 30 (FIGS. 1 and 2). Additionally, most conventional chain saws are provided with adjustable or other bolts such as shown at 37 and 38 and these can be utilized to bolster and stabilize the saw on the plate by tightening them against the uprights 34 and 35 as shown in FIGS. 1 and 2. The fact that the slide members 32 are moveable back and forth within their respective slides 30 and 31, and that the uprights 34 and 35 can be positioned relative to the bolts 37 or 38 so that either bolt can be in or out of the slot 36 provides flexibility in positioning the saw on the mounting plate.

In operation, a log 39 is placed in the trough of the table top 11, and extending outwardly therefrom, as at 42, to the length it is desired to cut off. The "V" shape of the table top 11 will not only support the log off and free of the ground but will also act to restrain it from lateral movement during sawing.

The sawing operation is initiated by simply grasping the handles 30 and 41 and swinging the saw 19, while supported and guided by its mounting plate 18, about the bolt 24, until the bladed chain of the saw comes into cutting engagement with the log 39. As the log is cut through, the extended portion 24 falls to the ground and the plate 18 carrying the saw is swung back into engagement with the head of the adjusting screw 29.

Because the saw is fixed to and moves integrally with the mounting plate during sawing, its chain will always be perpendicular to the log, the path of its cutting stroke will be accurately predetermined, its chain will always be maintained free from contact with the ground or other surfaces that might damage or dull its blades or cause injury to its operator, and the support provided by the mounting plate makes the saw easier and seemingly lighter to handle before, during, and after cutting.

It is to be understood that the form of the invention herein shown and described is to be taken as one embodiment only of the same, and that various changes in the size, shape and arrangement of parts, as well as various procedural changes, may be resorted to without departing from the spirit of the invention or the scope of the following claims.

I claim:

1. In wood cutting apparatus by which a log is supported in elevated position and against lateral movement thereof, and a chain saw assembly including a cutting chain, a motor for driving said chain and handles on said motor is mounted for swinging movement to bring said chain into cutting engagement with and pass it through said log beyond said log support; the improvement which comprises providing, as the mounting for said chain saw assembly, a plate for receiving said driving motor thereupon and which is pivotally mounted adjacent said log support to permit said swinging movement of said chain saw assembly when said motor is so received, extensions from said plate that are adjacent to but below said motor handles when said motor is received on said plate, means for connecting each of said motor handles to one of said adjacent extensions to temporarily secure said chain saw assembly on said mounting plate, and means for limiting the extent of pivotal movement of said plate.

2. Apparatus as defined in claim 1, in which said drive motor handles include a side handle and a rear handle, one of said extensions projects laterally and one rearwardly from said mounting plate, both are mounted for sliding movement relative to said plate, said connecting means are tightenable flexible clamps, and means is provided for adjusting the extent of pivotal movement of said plate in one direction.

3. Apparatus as defined in claim 2, in which said chain saw assembly also includes at least one bolt extending outwardly from one side of said motor for adjusting said assembly, and said means for temporarily securing said saw assembly on said mounting plate also includes uprights extending from said plate and positioned to be engageable by said bolt of said assembly adjusting means.

* * * * *